US006253498B1

(12) United States Patent
Fanucci

(10) Patent No.: US 6,253,498 B1
(45) Date of Patent: Jul. 3, 2001

(54) SELF-CONTAINED, MODULAR BUILDING SYSTEMS

(75) Inventor: Jerome P. Fanucci, Woburn, MA (US)

(73) Assignee: Kazak Composites, Inc., Woburn, MA (US)

( * ) Notice: Subject to any disclaimer, the term of this patent is extended or adjusted under 35 U.S.C. 154(b) by 0 days.

(21) Appl. No.: 09/426,813

(22) Filed: Oct. 23, 1999

(51) Int. Cl.[7] ..... E04B 1/346; E04B 7/16
(52) U.S. Cl. ..... 52/69; 52/68; 52/71; 52/143
(58) Field of Search ..... 52/68, 69, 143, 52/71

(56) References Cited

U.S. PATENT DOCUMENTS 414,976 * 11/1889 Harvey ..... 52/69
2,701,038 * 2/1955 Mooney ..... 52/69
2,751,635 * 6/1956 Donnahue ..... 52/69
2,883,713 * 4/1959 Zug ..... 52/71
2,890,498 * 6/1959 Bigelow ..... 52/69
3,653,165 * 4/1972 West ..... 52/69
4,742,653 * 5/1988 Napier ..... 52/68
4,989,379 * 2/1991 Suzuki ..... 52/66
5,596,843 * 1/1997 Watson ..... 52/71

* cited by examiner

*Primary Examiner*—Carl D. Friedman
*Assistant Examiner*—Kevin McDermott
(74) *Attorney, Agent, or Firm*—Weingarten, Schurgin, Gagnebin & Hayes LLP

(57) ABSTRACT

Self-contained, modular building systems that create temporary structures consisting of various panels that fold compactly for shipping, but that deploy into complete building segments, such that a large surface area of panels sufficient to provide a structure of superior size as compared with like known modular structures may be efficiently stored and conveniently deployed.

24 Claims, 7 Drawing Sheets

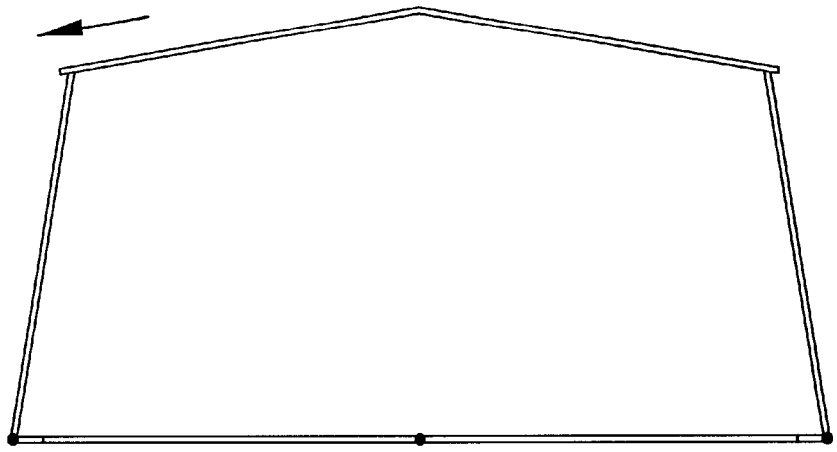
FIG. 7A
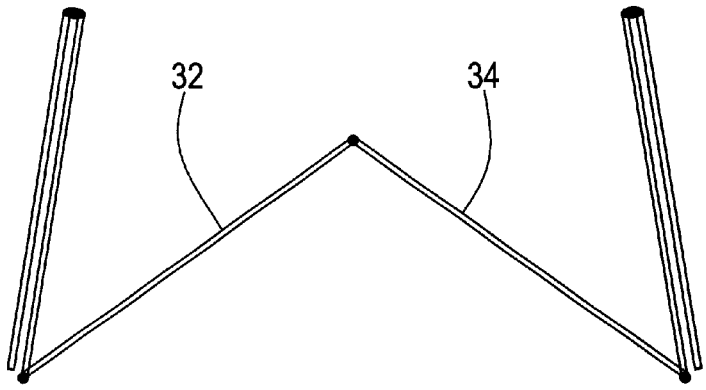
FIG. 7B
FIG. 7C
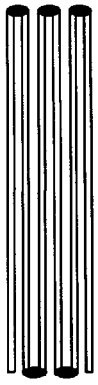

SELF-CONTAINED, MODULAR BUILDING SYSTEMS

FIELD OF INVENTION

The present invention relates generally to self-contained, modular building systems and methods for their deployment and storage.

BACKGROUND OF THE INVENTION

The desirability of sturdy, reliable, readily transportable, and easily deployed temporary shelters has been recognized since the dawn of time. Over the millennia, a variety of tent structures have been developed and are used to this day. New flexible, strong materials, such as Fibreglas®, polycarbonate, and other high-strength, lightweight, flexible polymeric materials have enabled new designs, for example "dome" tents, but these do not provide the maximum interior space often required for extended use. Nor do tents provide a sturdy, reliable structure that is durable enough for long-term use and that is capable of withstanding a variety of extreme environmental conditions.

While modular structures created from pre-fabricated parts are known, they also are limited in their application. Although such structures may allow for sturdier, more durable, and larger-sized shelter than do tents, they are not lightweight and do not provide the compactability when stored, portability, and ease of deployment required in many circumstances. Even other approaches developed for smaller transportable buildings that unfold in different ways are severely limited in their applicability. For example, one known structure folds in an accordion-like fashion. However, by virtue of its design, in order for it to fit into a standard shipping container it is limited to relatively small structures. Other known systems that employ folding, hinged panels have very complicated hinge mechanisms and require expensive, complicated tracks and leveling devices in order that the structure may be deployed without the hinge mechanisms jamming. In addition, such structures are severely limited in the terrain in which they may be deployed.

The ideal modular, non-permanent structure would be capable of long-term use under a variety of environmental and field conditions. It would be relatively lightweight, self-contained, and easily deployable. The ideal structure would be capable of being stored compactly in a rigid container that is optimally suitable for shipping.

BRIEF SUMMARY OF THE INVENTION

Accordingly, it is the principal object of the present invention to provide modular building systems that overcome the deficiencies of known temporary structures.

It is another object of the present invention to provide modular building systems that create a structure that is sturdy, reliable, readily transportable, and easily deployed.

It is a further object of the present invention to provide modular building systems that create a structure that is self-contained when stored in a compact container that is suitable for shipping.

It is yet another object of the present invention to provide modular building systems that create a structure that allows each pre-deployed segment to be moved through the interior of previously deployed segments of the shelter before its expansion The present invention relates to self-contained, modular building systems capable of providing relatively rigid, stable temporary structures that are sturdy, reliable, readily transportable, and easily deployed. The modules of the present invention each consist of various panels that fold compactly for shipping, but which easily deploy into complete building segments. An important feature of the systems of the present invention is that the size of the structures that they create is limited only by the size of the container used. Furthermore, a structure built using the systems of the present invention can be combined with one or more other like or compatible such structures to form a still larger structure that can also vary not only in its dimensions, but also in its configuration. For example, two rectangular structures could be combined to form one elongated rectangular structure, a T-shaped structure, or an L-shaped structure. Other combinations and possibilities are limited only by the number, design, and dimensions of the modules used and by the imagination of the designer/builder.

The systems of the present invention are unique in that they allow a large surface area of panels to be stored efficiently in a container from which they may be conveniently deployed. This results in temporary structures that have the maximum height, width, length, and floor area possible for a structure that is self-contained in one shipping container.

Other aspects and advantages of the present invention will be apparent upon consideration of the following detailed description hereof which includes numerous illustrative examples of the practice of the invention, with reference being made to the following figures:

DESCRIPTION OF THE FIGURES

FIGS. 7A–C show one means by which a self-contained, modular building unit of the present invention having a segmented floor may be folded for storage.

DETAILED DESCRIPTION

Figure 1:
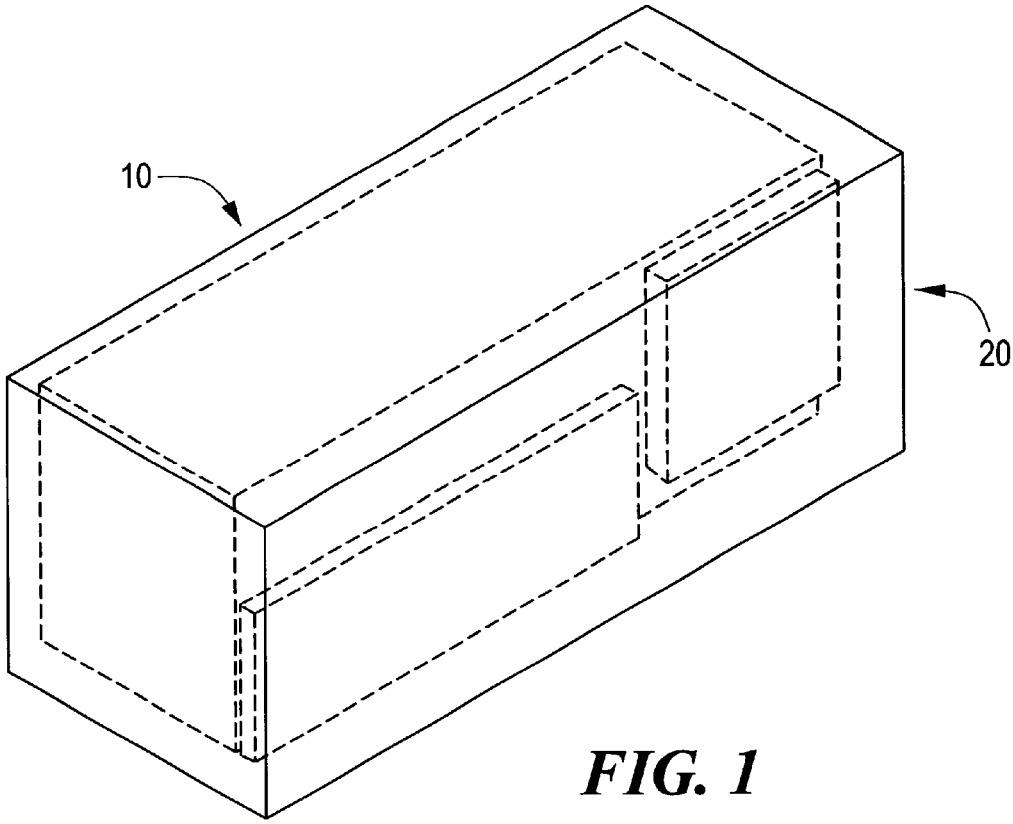
FIG. 1 shows a self-contained, modular building of the present invention packaged for shipping.

As shown in the Figures, the present invention relates to a modular building system 10 that folds for storage into a self-contained, shippable unit 20. Each building module of the present invention consists of a floor 12, left and right side wall panels 14 and 16, respectively, and roof 18. It is understood that the structure is bilaterally symmetrical and that where only one half of the structure is shown in the figures, the mirror half of the structure is formed and functions identically to the half illustrated.

In the preferred embodiment, hinge 22 at the floor-to-side-wall joint is located along floor 12 at some distance A from the intersection of floor 12 and side wall 14.

Figure 3A:
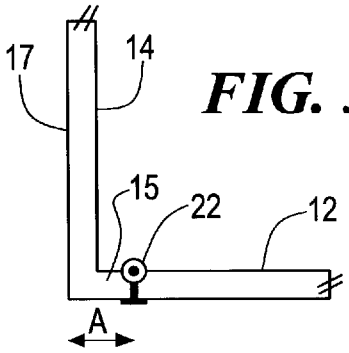
FIG. 3A shows an embodiment of the side wall-to-floor joint of a self-contained, modular building of the present invention.
Figure 4A:
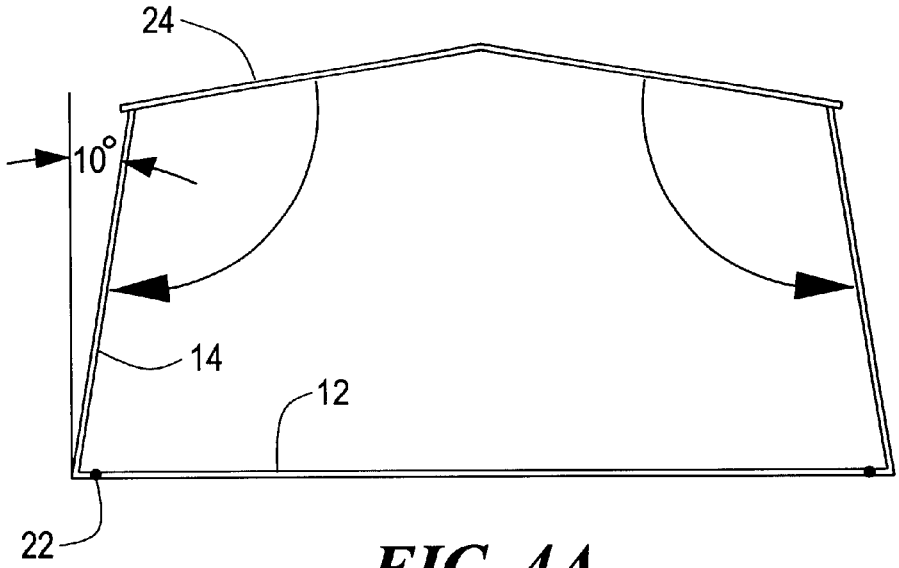
FIGS. 4A–C show one means by which a self-contained, modular building unit of the present invention having a unitary floor and two roof panels may be folded for storage.
Figure 4B:
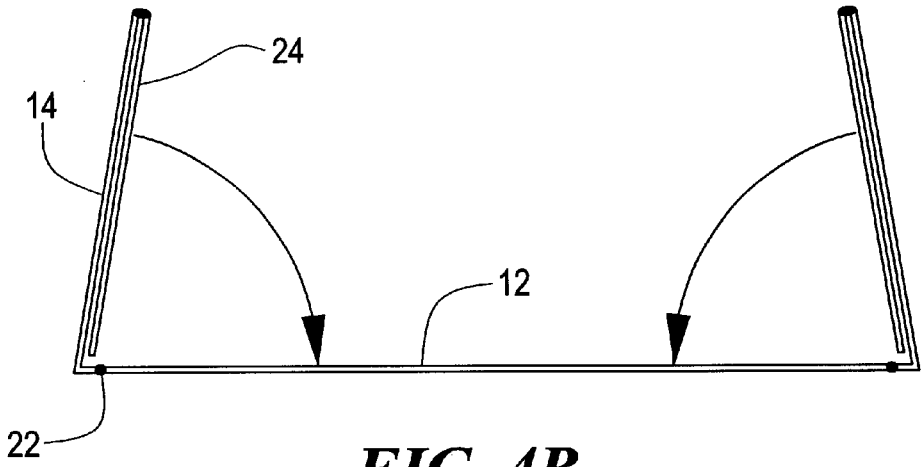
Figure 4C:
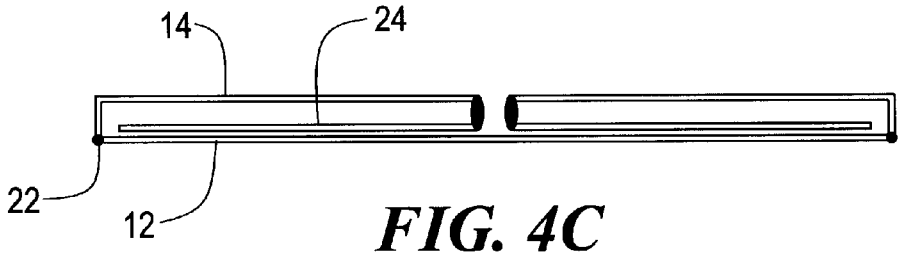

As shown more particularly in FIG. 3A, each wall panel comprises a wall segment 17 and a flange segment 15 extending inwardly at an angle from the wall segment 17 for the distance A. The angle between the wall segment and the flange segment may be substantially equal to or less than 90°. This construction allows roof panel 18 to first be folded down against side wall 14 before side wall 14 is folded down against floor 12 for storage, as shown in FIGS. 4A–4C. In addition, and perhaps more importantly, because the folded panel module is narrower than the deployed module, each pre-deployed panel set may be moved through the interior of previously deployed segments before deployment.

In an alternate embodiment shown in FIGS. 7A–C and 8A–C, the hinge line at the floor to side wall joint is located at the intersection of the floor 12 and side wall 14. In this embodimnent, the floor is composed of two panels 32 and 34 that are hinged, as shown in FIG. 7, or connectable to each other, as shown in FIG. 8.

The system is designed to be moved from its shipping position to its approximate erection position as a unit. However, the panel connection details of the module may be such that individual panels or all panels optionally can be detached to reduce the size and weight of the panels, if necessary. This removable panel provision also allows for the simplified insertion of "special" component panels, such as optional panels having side wall doors, windows, vents, electrical connections, air conditioning ports, or roof skylights. It also allows for the convenient repair or replacement of damaged panel sections in a module. Other special parts may be employed, such as panels to form the triangular gable ends 28.

Figure 2A:
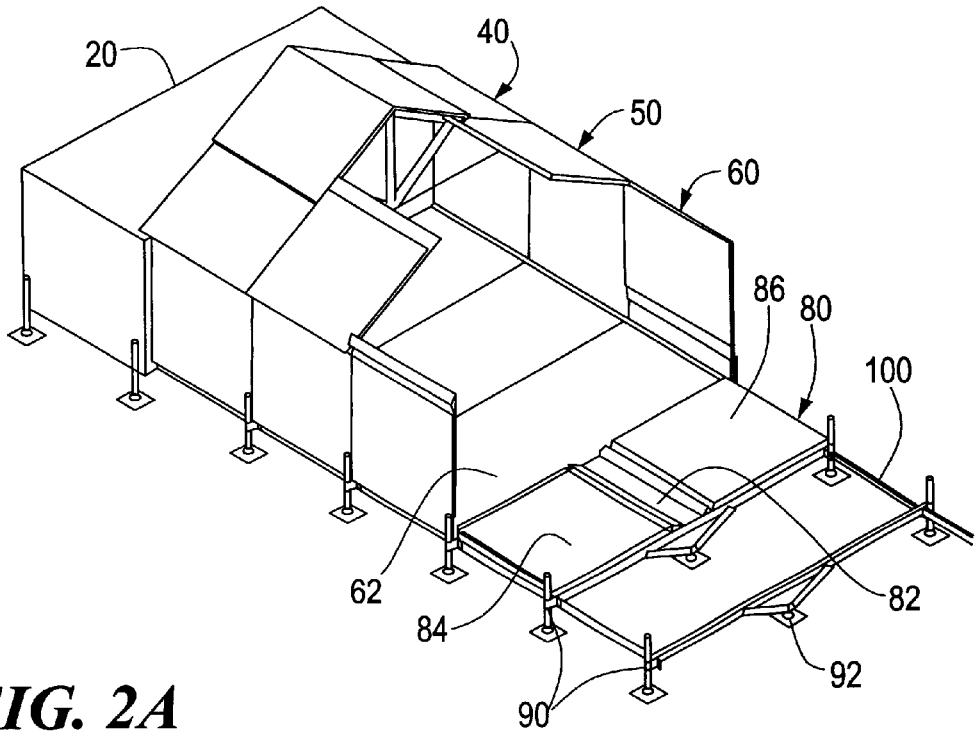
FIG. 2A shows a self-contained, modular building of the present invention in sequential states of deployment.
Figure 3B:
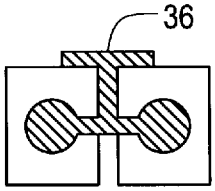
FIG. 3B shows an embodiment of a gasket suitable for connecting adjoining panels of different modules of a self-contained, modular building of the present invention.

FIG. 2A shows four modules, 40, 50, 60, and 80 in sequential phases of deployment. Module 80 is deployed by moving it through previously deployed modules 40–60. Floor panel 82 is deployed approximately adjacent to and parallel with floor panel 62 of the previous module. A gasket 36 (see FIG. 3B) is then optionally inserted between floor panels 82 and 62, such that they are connected. Gasket 36 also provides resistance to groundwater and vermin penetration of the floor. Jack 92 may be used to level floor panel 82 prior to its connection with floor panel 62. The use of such jacks is particularly desirable where the structure is to be deployed on uneven or debris-strewn terrain, where it is desirable to have space beneath floor 12 for electrical or other equipment, or where there is risk of flooding. In addition, center jacks 92 similarly may be used to increase the rigidity and load capacity of floor 12. The use of center jacks is particularly desirable where floor 12 is composed of more than one panel, as shown in FIGS. 7 and 8.

Figure 5A:
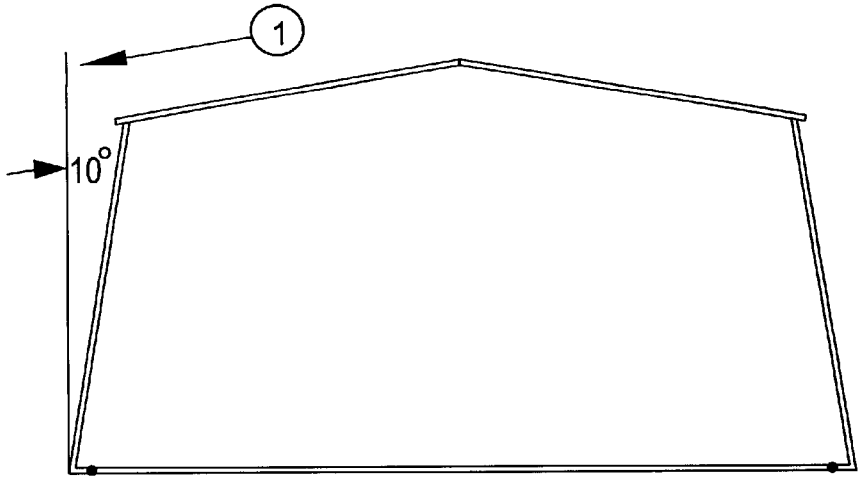
FIGS. 5A–C show another means by which a self-contained, modular building unit of the present invention having a unitary floor and two roof panels may be folded for storage.
Figure 5B:
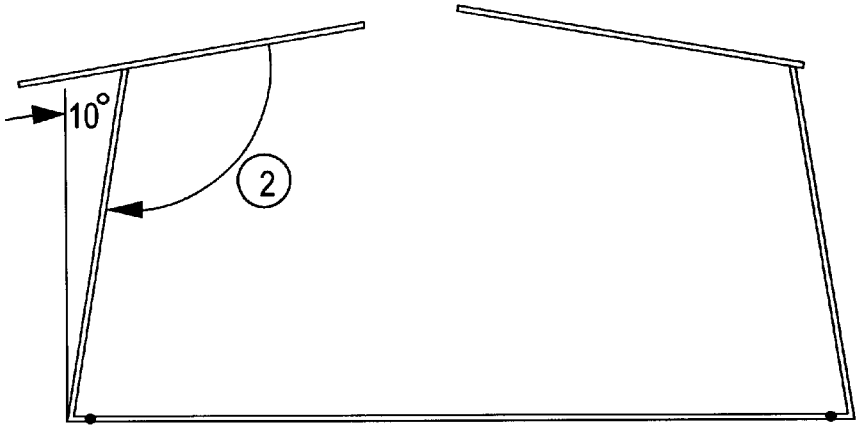
Figure 5C:
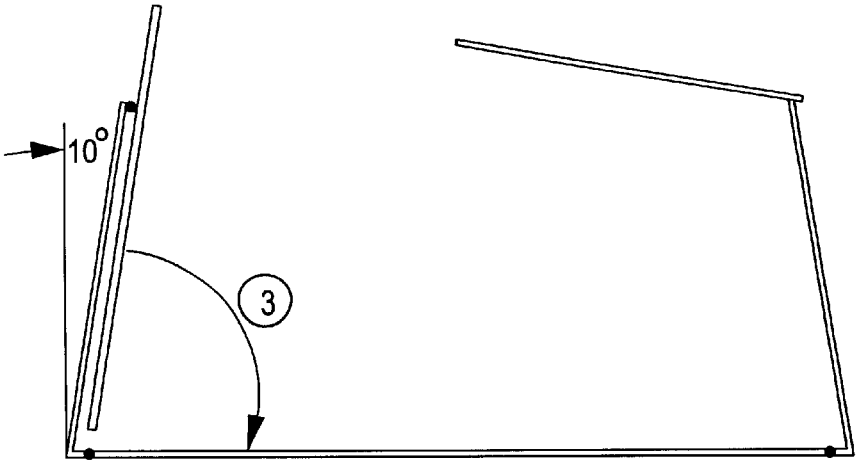
Figure 6A:
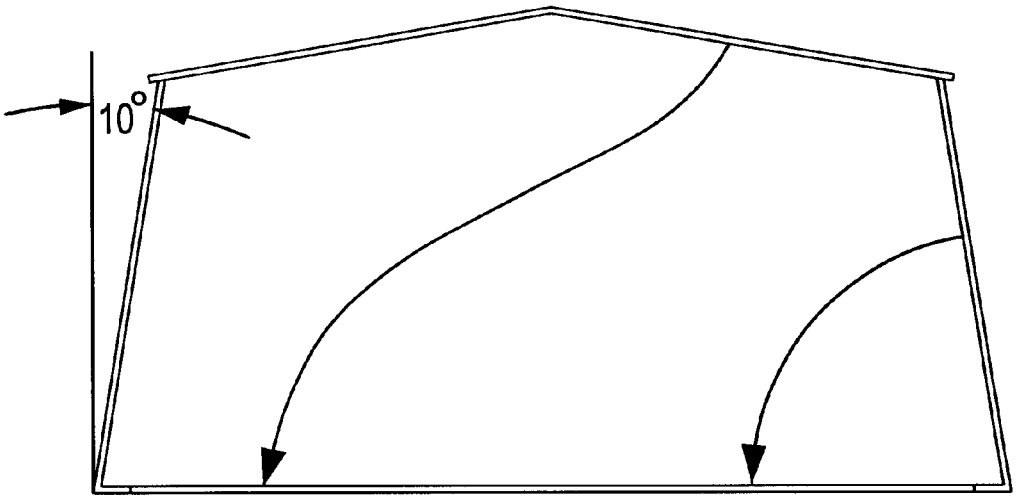
FIGS. 6A–B show a third means by which a self-contained, modular building unit of the present invention having a unitary floor and two roof panels may be folded for storage.
Figure 6B:
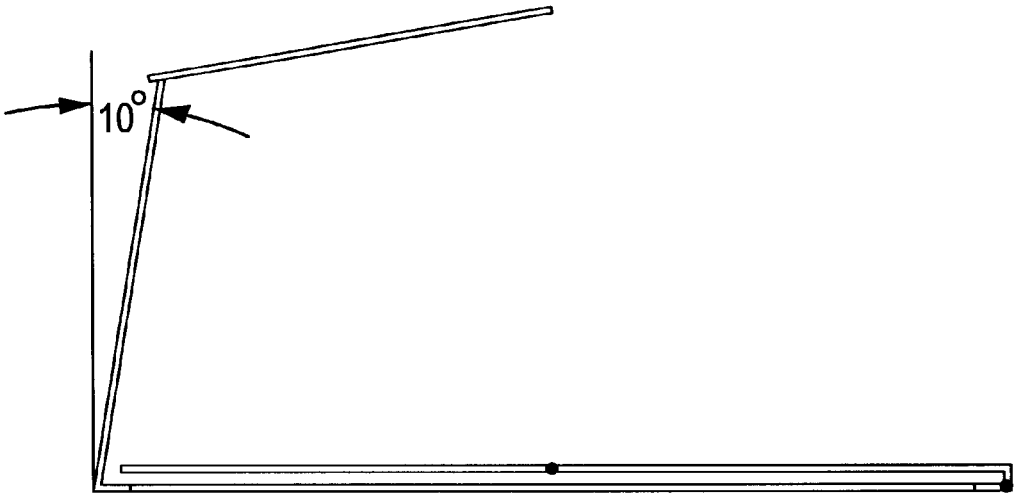

Left and right panel sets 84 and 86 respectively, of linked side wall and roof panels are then unfolded so that they are relatively perpendicular to floor 82. Note that in certain embodiments, particularly in embodiments where each side of the roof is one unitary panel, the fully deployed position of the side wall panels may be up to about ten degrees less than the normal line to floor 12, such as is shown in FIGS. 4–6.

That is, the angle between the flange segment 15 and the wall segment 17 of each panel is about 80°.

Figure 2B:
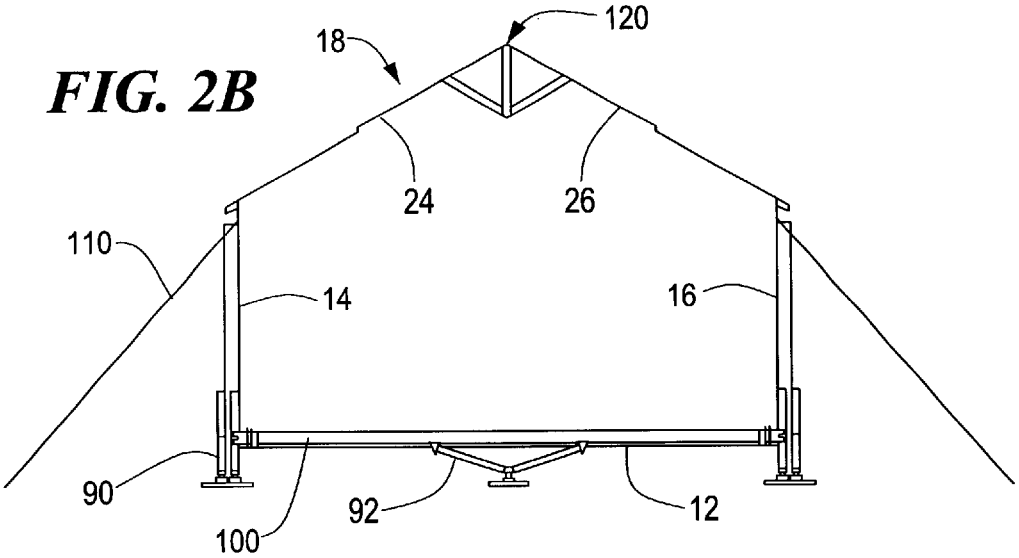
FIG. 2B shows an end elevation of a fully deployed self-contained, modular building of the present invention.

Unlike conventional building systems, the structures of the present invention may also employ guy wires 110, as shown in FIGS. 2B and C, to increase their stiffness and resistance to wind and snow loads, making such structures a hybrid of tent and conventional rigid wall building technology. Where it is desirable to stabilize the deployed structure by means of guy wires 110, side panels 14 and 16 may be guyed to the ground before the roof is deployed.

Figure 3C:
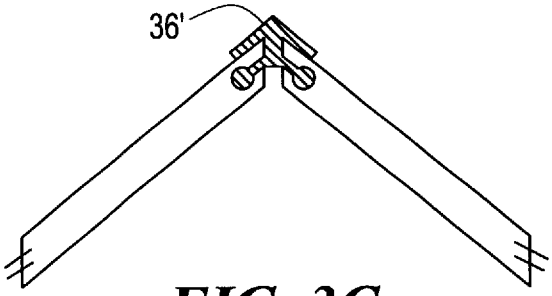
FIG. 3C shows a gasket suitable for connecting adjoining roof panels of different modules of a self-contained, modular building of the present invention.

As shown in module 50 of FIG. 2A, left roof panel 24 and right roof panel 26 are then unfolded from left and right side wall panels 14 and 16, respectively, and joined to form structure peak 120. The connection between left roof panel 24 and right roof panel 26 may be achieved by means of a leak-proof connection means, such as gasket 36' shown in FIG. 3 C. The system optionally includes a folding truss 130 that may be deployed to support the roof.

Where roof 18 is formed from more than one panel, the lowest roof panel is deployed first, followed by the upper roof panel(s). These separate roof panels may either fold against each other or be slidable against each other for storage. Where the panels fold against each other, hinges or functionally equivalent joining means are employed. Where the panels are slidable against each other, such slidability is achieved by means of rollers, tracks, bearings, or other functionally equivalent means. The upper panel(s) optionally may overlap the lower panel(s), adding to the watertightness and structural performance of the joints.

The trailing edges of this newly-deployed module would then be biased tightly against the leading edges of the previously-deployed module and joined in position by appropriate connections. The process would then be repeated with the next undeployed module panel set in the shipping package.

Figure 8A:
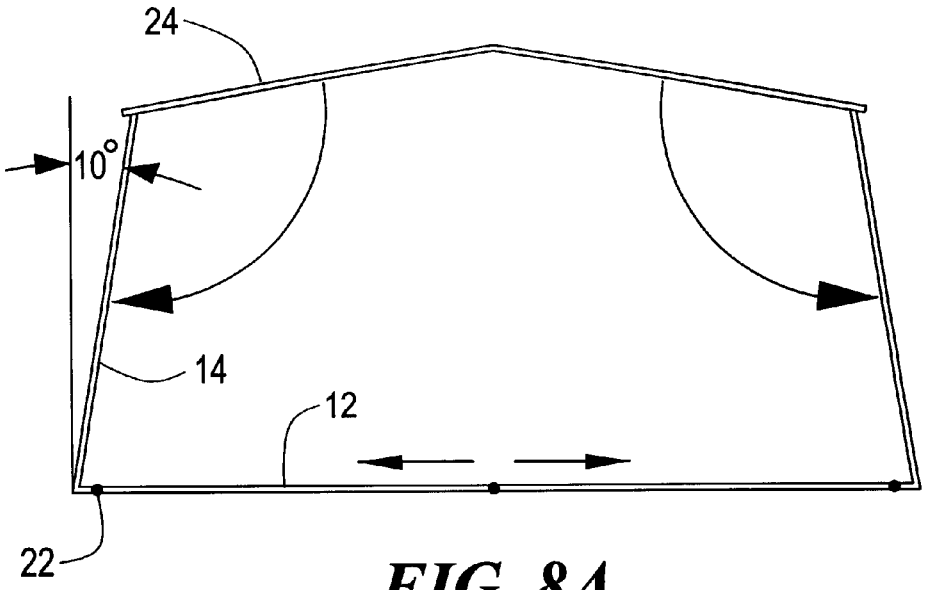
FIGS. 8A–C show another means by which a self-contained, modular building unit of the present invention having a segmented floor may be folded for storage.
Figure 8B:
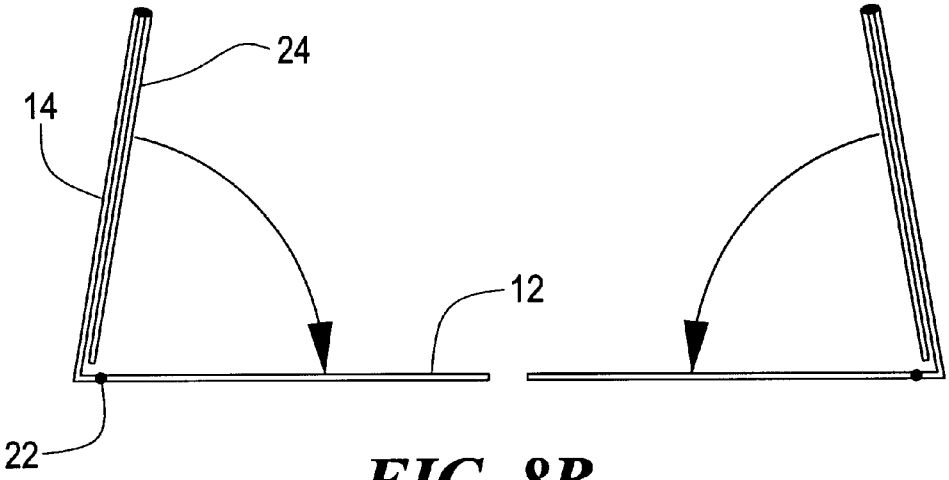
Figure 8C:
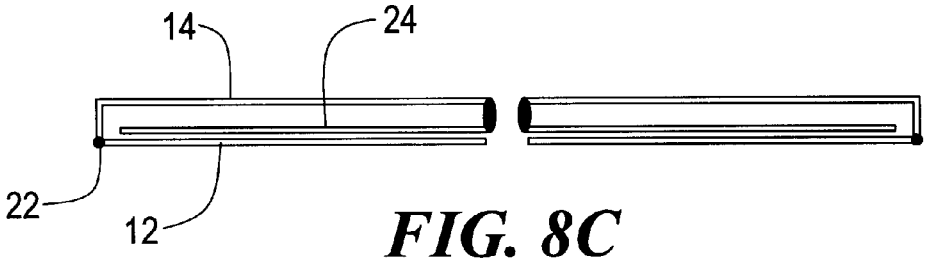

Structures constructed in accordance with the principles of the present invention may be broken down and refolded and re-stored for shipment in a variety of ways, as determined by their construction. FIGS. 4C–A, 5C–A, and 6C–A show three possible methods of folding a module having single right and left roof panels and a unitary floor. FIGS. 7C–A show how a module having a floor composed of right and left hinged segments may be folded for storage. FIGS. 8C–A show how a module having a floor composed of right and left segments that separate may be folded for storage.

Figure 2C:
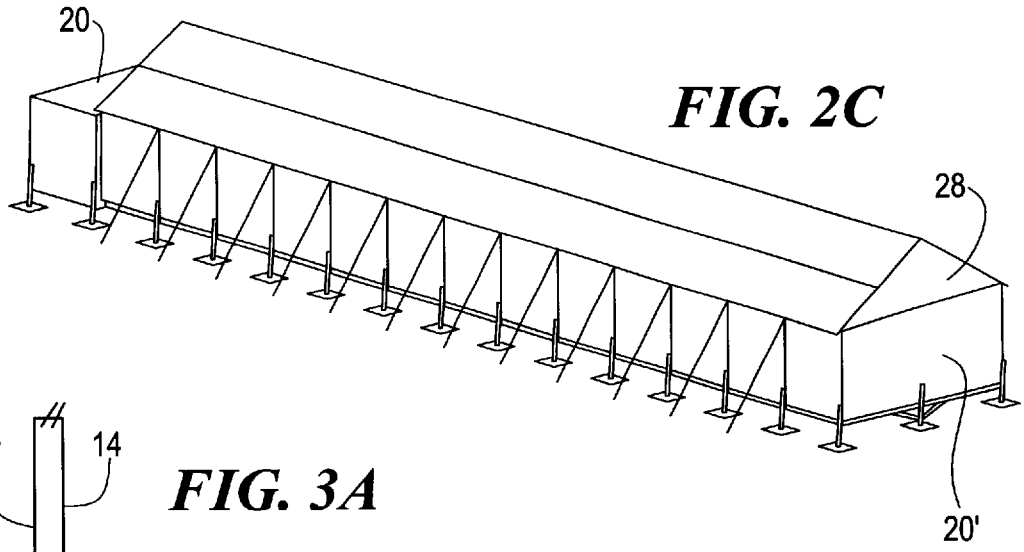
FIG. 2C shows a perspective view of a fully deployed self-contained, modular building of the present invention.

In accordance with the principles of the present invention, shipping container 20 may form one segment of the usable space in the fully deployed structure. Generally, side wall 20' of the container initially would be removed so that the folded panel sets may be deployed. As shown in FIG. 2C, side wall 20' then would be used as the end wall of the completed structure.

In one embodiment, the present invention comprises a new type of mobile building that will pack into an 8×8×20 foot shipping container, and then deploy to form a building with a nominal size of 20×96 feet. It is contemplated that this modular building system could be used for any sized building packaged in any container or shipping system. This embodiment of the invention may be efficiently packaged into the shipping container, pallet, or military container shelter, and deployed to construct a building.

Panels used in structures constructed in accordance with the principles of the present invention may be made of any material, including wood, sheet or corrugated metal, or sandwich construction. In one embodiment, sandwich panels consisting of a lightweight foam or honeycomb core and glass fiber-reinforced plastic composite skins may be used. Panel edge details such as hinges and close-outs may be formed into the panel during the initial fabrication, resulting in a single unitized part, or they may be bonded, bolted, riveted, or otherwise joined in a secondary operation. Not all panels need to be of the same construction. For example, where bearing a snow load is not a factor, the roof panels may be made of a lightweight, less-rigid material than are the load-bearing wall panels. Employing guy wires further allows for reductions in weight and load strength of the panels.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A self-contained, modular building unit comprising:

a floor comprising a floor panel having four edges, first and second edges of said four edges being parallel; and first and second wall panels, each of said first and second wall panels comprising a wall segment and a flange segment extending at an angle from said wall segment, the angle between said wall segment and said flange segment less than 90°, said flange segments hingedly connected to said floor panel along said first and second edges of said floor panel respectively, and wherein said flange segments lie in a plane formed by said floor panel and form extended edge portions of said floor when said building unit is in a deployed position.

2. The building unit of claim 1, wherein the angle is about 80°.

3. The building unit of claim 1, wherein said first and second wall segments lie parallel to said floor panel when said building unit is in a folded position.

4. The building unit of claim 1, further comprising two roof panels, each roof panel movably connected to an associated one of said first and second wall panels along an edge spaced from said flange segment.

5. The building unit of claim 4, wherein each roof panel is hingedly connected to the associated one of said first and second wall panels.

6. A self-contained, modular building unit comprising:

a floor comprising a floor panel having four edges, first and second edges of said four edges being parallel;

first and second wall panels, each of said first and second wall panels comprising a wall segment and a flange segment extending at an angle from said wall segment, said flange segments hingedly connected to said floor panel along said first and second edges of said floor panel respectively, and wherein said flange segments lie in a plane formed by said floor panel and form extended edge portions of said floor when said building unit is in a deployed position; and two roof panels, wherein each roof panel is hingedly connected to an associated one of said first and second wall panels along an edge spaced from said flange segment to fold between the associated wall panel and the floor panel when said building unit is in a folded position.

7. A self-contained, modular building unit comprising:

a floor comprising a floor panel having four edges, first and second edges of said four edges being parallel;

first and second wall panels, each of said first and second wall panels comprising a wall segment and a flange segment extending at an angle from said wall segment, said flange segments hingedly connected to said floor panel along said first and second edges of said floor panel respectively, and wherein said flange segments lie in a plane formed by said floor panel and form extended edge portions of said floor when said building unit is in a deployed position; and two roof panels hingedly connected to an associated one of said first and second wall panels along an edge spaced from said flange segment, wherein each roof panel and the associated wall panel are hingedly connected to fold with the associated wall panel between the roof panel and the floor panel when said building unit is in a folded position.

8. The building unit of claim 4, wherein each roof panel is slidably connected to the associated one of said first and second wall panels.

9. The building unit of claim 4, wherein said roof panels are connectable together along a peak when said building unit is in a deployed position.

10. The building unit of claim 9, further comprising a seal between said roof panels along said peak.

11. The building unit of claim 10, wherein the seal comprises a gasket.

12. The building unit of claim 1, wherein said floor panel is formed of two hingedly connected floor segments.

13. The building unit of claim 1, wherein said floor panel is a unitary panel.

14. A self-contained, modular building unit comprising:

a floor comprising a floor panel having four edges, first and second edges of said four edges being parallel;

first and second wall panels, each of said first and second wall panels comprising a wall segment and a flange segment extending at an angle from said wall segment, said flange segments hingedly connected to said floor panel along said first and second edges of said floor panel respectively, and wherein said flange segments lie in a plane formed by said floor panel and form extended edge portions of said floor when said building unit is in a deployed position; and wherein at least a third edge of said floor panel includes a seal fitting configured to receive a seal with an adjacent building unit.

15. The building unit of claim 1, wherein said building unit is symmetrical about a center line parallel to said first and second edges of said floor panel.

16. A modular building system comprising at least two modular, self-contained building units as in claim 1.

17. The building system of claim 16, further comprising a seal disposable between adjacent building units.

18. The building system of claim 17, wherein the seal comprises a gasket.

19. The building system of claim 16, further comprising guy wires attachable to said building units.

20. The building system of claim 16, further comprising at least one leveling jack disposable beneath at least one of said building units.

21. The building system of claim 16, further comprising an end wall connectable to at least one of said building units.

22. The building system of claim 16, further comprising a shipping container, said building units collapsible to a size that fits within said shipping container.

23. The building system of claim 22, wherein said shipping container includes at least one wall, said at least one wall configured to form an end wall connectable to at least one of said building units in a deployed position.

24. A self-contained, modular building unit comprising:

a floor comprising first and second floor segments each having an upper surface and a lower surface and at least two parallel edges, the first and second floor segments hingedly connected along adjacent parallel edges to be foldable about an axis defining a center line of the building unit, wherein in a folded position the lower surfaces of each of the first and second floor segments are facing and in a deployed position the first and second floor segments are substantially coplanar;

first and second wall panels each having an inner surface and an outer surface, the first and second wall panels having lower edges hingedly connected to the first and second floor segments along outer edges of the parallel edges, wherein in a folded position the inner surfaces of the first and second wall panels face the upper surfaces of the floor segments respectively;

first and second roof panels each having an inner surface and an outer surface, the first and second roof panels having lower edges hingedly connected to upper edges of the first and second wall panels respectively, wherein in a folded position the outer surfaces of the first and second roof panels face the outer surfaces of the first and second wall panels respectively; and wherein the first and second roof panels are connectable together along upper edges to form a peak when the building unit is in a deployed position.

* * * * *

UNITED STATES PATENT AND TRADEMARK OFFICE

CERTIFICATE OF CORRECTION

PATENT NO. : 6,253,498 B1
DATED : July 3, 2001
INVENTOR(S) : Jerome P. Fanucci et al.

It is certified that error appears in the above-identified patent and that said Letters Patent is hereby corrected as shown below:

Title page,
Item [75], Inventor:, please add the following inventor -- James J. Gorman, Boxborough, MA --; and Column 3,
Line 29, "embodimnent" should read -- embodiment --.

Signed and Sealed this

Eighteenth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,253,498 B1
DATED : July 3, 2001
INVENTOR(S) : Jerome P. Fanucci

It is certified that error appears in the above-identified patent and that said Letters Patent is hereby corrected as shown below:

Column 1,
Line 3, prior to "FIELD OF THE INVENTION", please insert the following paragraph:
-- STATEMENT REGARDING FEDERALLY SPONSORED RESEARCH OR DEVELOPMENT This invention was made with Government support under contract DAAN02-98-C-4042 awarded by the US Army Soldier System Center, Natick, MA. The Government has certain rights in the invention. --

Signed and Sealed this

Twenty-ninth Day of March, 2005

JON W. DUDAS
*Director of the United States Patent and Trademark Office*